US005187036A

United States Patent [19]

Matsui et al.

[11] Patent Number: 5,187,036

[45] Date of Patent: Feb. 16, 1993

[54] ELECTROPHOTOGRAPHIC PHOTOSENSITIVE MATERIAL

[75] Inventors: Naoyuki Matsui; Shigemasa Takano, both of Tokyo, Japan

[73] Assignee: NEC Corporation, Tokyo, Japan

[21] Appl. No.: 703,727

[22] Filed: May 21, 1991

[30] Foreign Application Priority Data

May 22, 1990 [JP] Japan ..... 2-131800

[51] Int. Cl.[5] ..... G03G 5/047

[52] U.S. Cl. ..... 430/59; 430/80

[58] Field of Search ..... 430/59, 80, 83

[56] References Cited

U.S. PATENT DOCUMENTS 4,839,252 6/1989 Murata et al. ..... 430/59

FOREIGN PATENT DOCUMENTS 144791 6/1985 European Pat. Off. .
314100 5/1989 European Pat. Off. .
401782 12/1990 European Pat. Off. .
231545 12/1984 Japan ..... 430/59
121460 6/1987 Japan .
210941 9/1988 Japan ..... 430/59
129652 5/1990 Japan .
503200 2/1976 U.S.S.R. ..... 430/80
1040461 9/1983 U.S.S.R. ..... 430/80

OTHER PUBLICATIONS

Undzenas, "Photosemiconductor Polymer for Electrophotography", Chemical Abstracts, vol. 94, No. 10, May 1981, p. 593.

*Primary Examiner*—Roland Martin
*Attorney, Agent, or Firm*—Sughrue, Mion, Zinn, Macpeak & Seas

[57] ABSTRACT

As a charge transport material for a charge transport layer of an electrophotographic photosensitive material, a poly-2,3-epoxypropyl carbazole compound is used together with a specific hydrazone compound and/or a specific butadiene compound. Film-formation property and adhesive property of the charge transport layer are much improved thereby to enable use of a photoconductive material in a higher concentration.

7 Claims, 3 Drawing Sheets

ELECTROPHOTOGRAPHIC PHOTOSENSITIVE MATERIAL

BACKGROUND OF THE INVENTION

1. Field of the Invention

The present invention relates to a highly functional electrophotographic photosensitive material, and more particularly to an electrophotographic photosensitive material which has photosensitivity suitable for use with a semiconductor laser and is easy to control its properties.

2. Description of the Prior Art

Recently, non-impact printer technique attained a great development and consequently photoprinters of electrophotography system, which enable to obtain a high definition and a high speed by using a laser beam or an LED as a light source, are now widely spreading in the market. Therefore, intensive research and development are made to try to obtain photosensitive materials which satisfy requirements of such photoprinters.

Particularly when a laser beam is used as a light source, there is a need to obtain a photosensitive material having a photosensitivity up to a near infrared region. It is because mostly a semiconductor laser apparatus is used owing to the merits of compactness, cheapness and simplicity, but their oscillation wavelength is now limited to a relatively longer wavelength range of a near infrared region. Accordingly, it is not appropriate to use conventional photosensitive materials, which have been used for electrophotographic copying machines and have a sensitivity in a visible region, for a semiconductor laser apparatus.

It is known that some organic materials satisfy the need as above mentioned. They are, for example, indoline dyes, polyazo dyes, phthalocyanine dyes, naphthoquinone dyes, etc. At present, however, the indoline dyes enable to obtain a longer wavelength range but are lacking in a utilizable stability, that is, repeating property; the polyazo dyes are difficult to obtain a longer wavelength range and also have disadvantages in its production; and naphthoquinone dyes have a problem in its sensitivity.

On the other hand, the phthalocyanine dyes have spectrum sensitivity peaks in the long wavelength region of not less than 600 nm, have high sensitivities and further change their spectrum sensitivities in accordance with the kinds of their center metals and their crystal forms. They are therefore considered as suitable for dyes for a semiconductor laser apparatus and so research and development of them are intensively conducted.

It has been attempted in these days to use titanyl phthalocyanine having relatively high sensitive electrophotographic properties as described in Japanese Patent Laid-open Nos. 49,544/84, 23,928/86, 109,056/86 and 275,272/87. According to these literatures, it is understood that their properties are different owing to their crystal forms and that in order to produce these various crystal forms, special purification and special solvent treatment are required. Further, the solvent to be used for such treatment is one that is different from the solvent to be used in forming the dispersion coating film. It is because the various crystals to be formed have tendency to easily grow in the solvent for the crystal growing treatment and so, if such solvent is used also as the solvent for the coating, it is difficult to control the crystal form and the particle size. This causes low stability of the coating material and eventually the electrostatic properties are significantly damaged. Therefore, ordinarily in the treatment of forming the coating material, a chlorine series solvent such as chloroform, which does not substantially promote the crystal growth, is used. This solvent however does not always show good dispersion property for the titanyl phthalocyanine and so causes some problems in the dispersion stability of the coating material.

As for structures of such photosensitive materials, there are a multilayer structure having a function separation type photosensitive material which includes, as separate layers, a material generating electric charge carriers (hereinafter called a charge generation material) and a material which receives the generated electric charge carriers and transports them (hereinafter called a charge transport material); and a single layer structure having a single layer type photosensitive material which executes generation of electric charge carriers and transportation of electric charge by means of the same material. The multilayer structures are adopted more than the single layer structures because the formers have the larger range of selection of materials and have higher sensitivity than the latter.

As for the charge transport material, particularly a hole transport material, there have been various proposals of photosensitive materials utilizing hydrazone compounds, butadiene compounds, poly-2,3-epoxypropyl carbazole compounds and so on, and some of them are actually used in the industry.

The prior art photosensitive materials containing hydrazone compounds have excellent electric properties, but have problems of deterioration by optical fatigue. Further, the titanyl phthalocyanine in general has a large ionization potential, and so if it is used with a material having a small ionization potential such as hydrazone compounds, hole injection from the titanyl phthalocyanine to the hydrazone compounds easily occurs owing to the large difference of ionization potential. This cause a problem of low charging ability and thus of considerable reduction of surface voltage owing to repeated used and optical fatigue coming therefrom. In case the hydrazone compounds are used for a dispersed type photosensitive material containing the charge generation material and the charge transport material in a single layer, it is very difficult to let the charge generation material be contained in a large amount for improving sensitivity, while retaining charging ability.

Further, the prior art photosensitive materials mainly consisting of butadiene compounds have good resistance to optical fatigue, but have no good electric properties.

In addition, the hydrazone compounds and the butadiene compounds do not have tendency to form a film and so it is required to dissolve them in a solvent together with a resin or a binder. This causes dilution of density and so results in poor achievement of their functions.

Further, the prior art photosensitive materials utilizing poly-2,3-epoxypropyl carbazole compounds alone do not show good film-formation property and moreover have ionization potential larger than that of the titanyl phthalocyanine. Therefore, hole injection is difficult to occur and so mobility in negative charge is made slow to invite tendency to elevate a residual voltage.

SUMMARY OF THE INVENTION

The present invention is made in consideration of the foregoing conventional circumstances. The object of the present invention therefore is to provide an electrophotographic photosensitive material having photosensitivity suitable for use with a semiconductor laser and being easy to control its properties, by combination of organic photosensitive materials.

Thus, the present invention provides an electrophotographic photosensitive material containing, as a hole transport material for forming a charge transport layer, a poly-2,3-epoxypropyl carbazole compound represented by the following general formula [A] and a hydrazone compound represented by the following general formula [I] in combination:

[A]

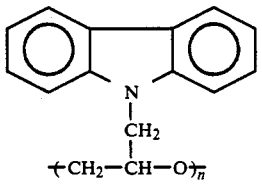

[I]

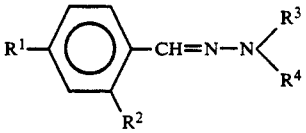

(wherein $R^1$ represents a hydrogen atom, a substituted or unsubstituted alkyl or alkoxy group, a halogen atom or a substituted or unsubstituted amino, morpholino or piperidino group, or $R^1$ may form a substituted or unsubstituted carbazolyl group together with the phenyl group in the formula; $R^2$ represents a hydrogen atom or a substituted or unsubstituted alkyl, alkoxy or aralkyloxy group; and $R^3$ and $R^4$ independently or both represent a hydrogen atom or a substituted or unsubstituted alkyl, aryl or aralkyl group, or $R^3$ and $R^4$ may form a ring together with the nitrogen atom in the formula to which they are linked, to form a substituted or unsubstituted pyridinium, piperidino or carbazolyl group or the like).

The present invention provides also an electrophotographic photosensitive material containing, as a hole transport material, the poly-2,3-epoxypropyl carbazole compound represented by the above formula [A] and a butadiene compound represented by the following general formula [II] in combination:

[II]

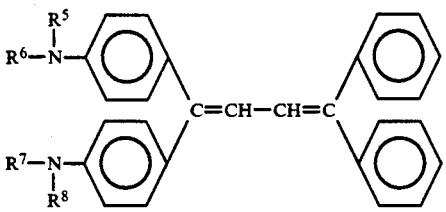

(wherein $R^5$, $R^6$, $R^7$ and $R^8$ represent same or different alkyl groups).

It is possible for the electrophotographic photosensitive material of the present invention to contain both of the above hydrazone compound of the formula [I] and the above butadiene compound of the formula [II] together with the poly-2,3-epoxypropyl carbazole compound of the formula [A]. Further, the electrophotographic photosensitive material of the present invention may be formed in either a multilayer form or a dispersed form.

A charge generation material, which is contained in either one of the above mentioned electrophotographic photosensitive material, preferably includes, as the effective components, a composition crystal as described in the U.S. Pat. application Ser. No. 07/534,084, which contains a total of not more than 50 parts by weight of one or more kinds from among metal-free aza-phthalocyanine porphin derivatives, metallo-aza-phthalocyanine porphin derivatives, metal-free phthalocyanine, metallo-phthalocyanine, metal-free naphthalocyanine or metallo-naphthalocyanine (wherein metal-free aza-phthalocyanine porphin derivatives, metallo-aza-phthalocyanine porphin derivatives, metal-free phthalocyanine and metallo-phthalocyanine may have a substitutional group in the benzene nucleus, and metal-free naphthalocyanine and metallo-naphthalocyanine may have a substitutional group in the naphthyl nucleus) and 100 parts by weight of titanyl phthalocyanine, and the above-mentioned composition crystal preferably has in its infrared absorption spectrum characteristically strong absorptions at absorption wavelength of $1490\pm2$ cm$^{-1}$, $1415\pm2$ cm$^{-1}$, $1332\pm2$ cm$^{-1}$, $1119\pm2$ cm$^{-1}$, $1072\pm2$ cm$^{-1}$, $1060\pm2$ cm$^{-1}$, $961\pm2$ cm$^{-1}$, $893\pm2$ cm$^{-1}$, $780\pm2$ cm$^{-1}$, $751\pm2$ cm$^{-1}$ and $730\pm2$ cm$^{-1}$.

One of the hole transport materials to be used in the present invention is, as above mentioned, the poly-2,3-epoxypropyl carbazole compound of the formula [A]:

[A]

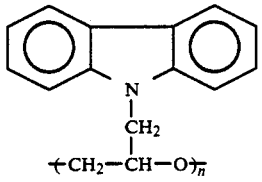

Another one of the hole transport materials to be used in the present invention is, as above mentioned, the hydrazone compound of the formula [I]:

[I]

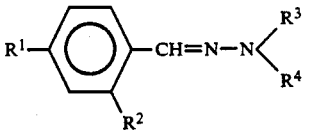

As for the hydrazone compound of the formula [I], the following compounds (a) to (l) may be mentioned as preferable examples:

(a) p-dimethylaminobenzaldehyde-(diphenyl hydrazone)

(a)

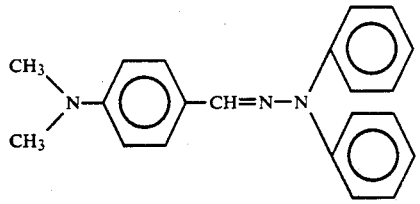

(b) p-diethylaminobenzaldehyde-(diphenyl hydrazone)

(b)

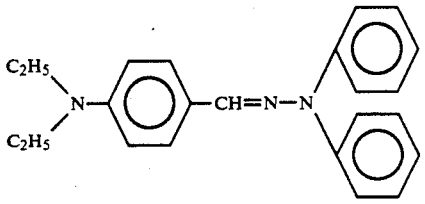

(c) p-diphenylaminobenzaldehyde-(diphenyl hydrazone)

(c)

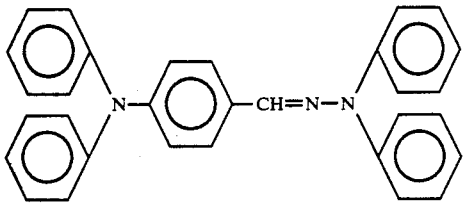

(d) p-dibenzylaminobenzaldehyde-(diphenyl hydrazone)

(d)

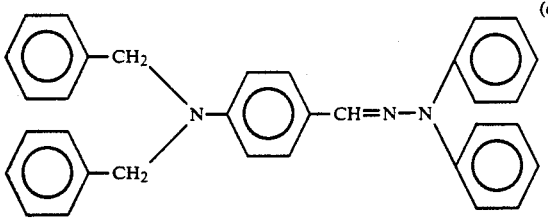

(e) p-(benzyl-methoxyphenyl)aminobenzaldehyde-(diphenyl hydrazone)

(e)

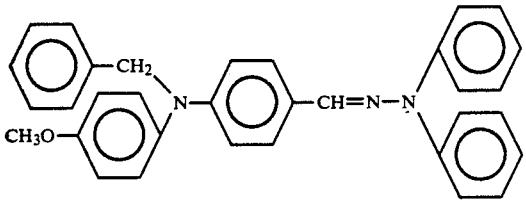

(f) o-methyl-p-diethylaminobenzaldehyde-(diphenyl hydrazone)

(f)

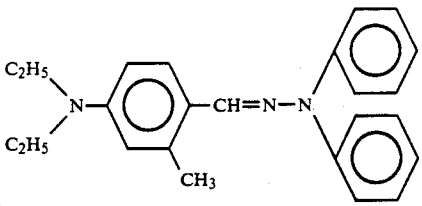

(g) o-methyl-p-dibenzylaminobenzaldehyde-(diphenyl hydrazone)

(g)

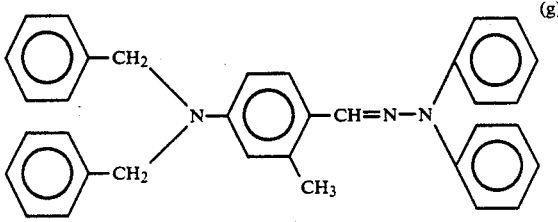

(h) o-methoxy-p-diethylaminobenzaldehyde-(diphenyl hydrazone)

(h)

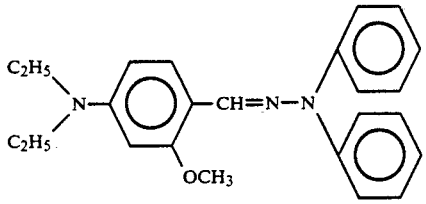

(i) o-benzyloxy-p-diethylaminobenzaldehyde-(diphenyl hydrazone)

(i)

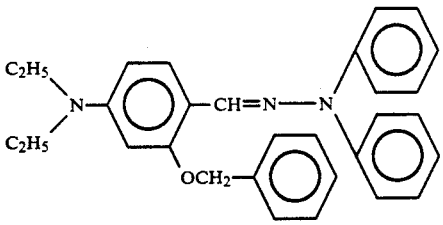

(j) p-diethylaminobenzaldehyde-(methyl-phenyl hydrazone)

(j)

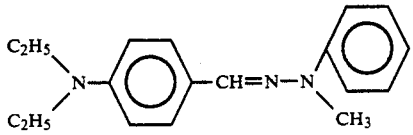

(k) o-methyl-p-dibenzylaminobenzaldehyde-(methyl-phenyl hydrazone)

(k)

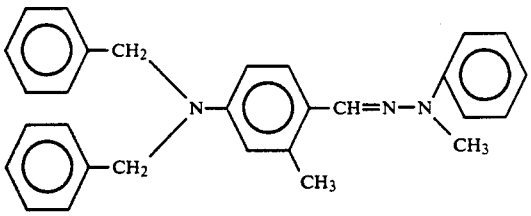

(l) o-methyl-p-dibenzylaminobenzaldehyde-(benzylphenyl hydrazone)

(l)

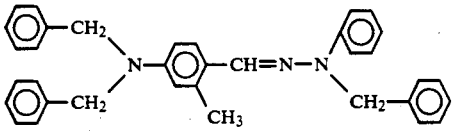

Still another one of the hole transport materials to be used in the present invention is, as above mentioned, the butadiene compound of the formula [II]:

[II]

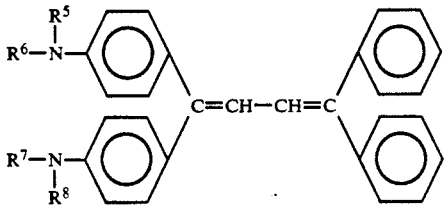

As for the butadiene compound of the formula [II], the following compounds (m) and (n) may be mentioned as preferable examples:

(m) 1,1-bis-(p-dimethylaminophenyl)-4,4-diphenyl-1,3-butadiene (m)

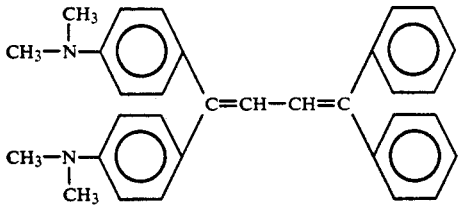

(n) 1,1-bis-(p-diethylaminophenyl)-4,4-diphenyl-1,3-butadiene (n)

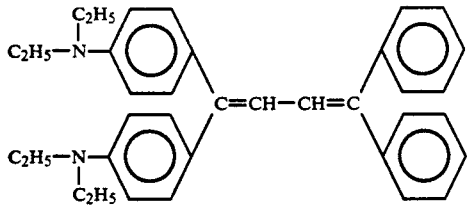

Particularly preferable hydrazone or butadiene compounds are the following compounds:

(b) p-diethylaminobenzaldehyde-(diphenyl hydrazone), (c) p-diphenylaminobenzaldehyde-(diphenyl hydrazone), (g) o-methyl-p-dibenzylaminobenzaldehyde-(diphenyl hydrazone), or (n) 1,1-bis-(p-diethylaminophenyl)-4,4-diphenyl-1,3-butadiene.

DETAILED DESCRIPTION OF THE INVENTION

Figure 1:
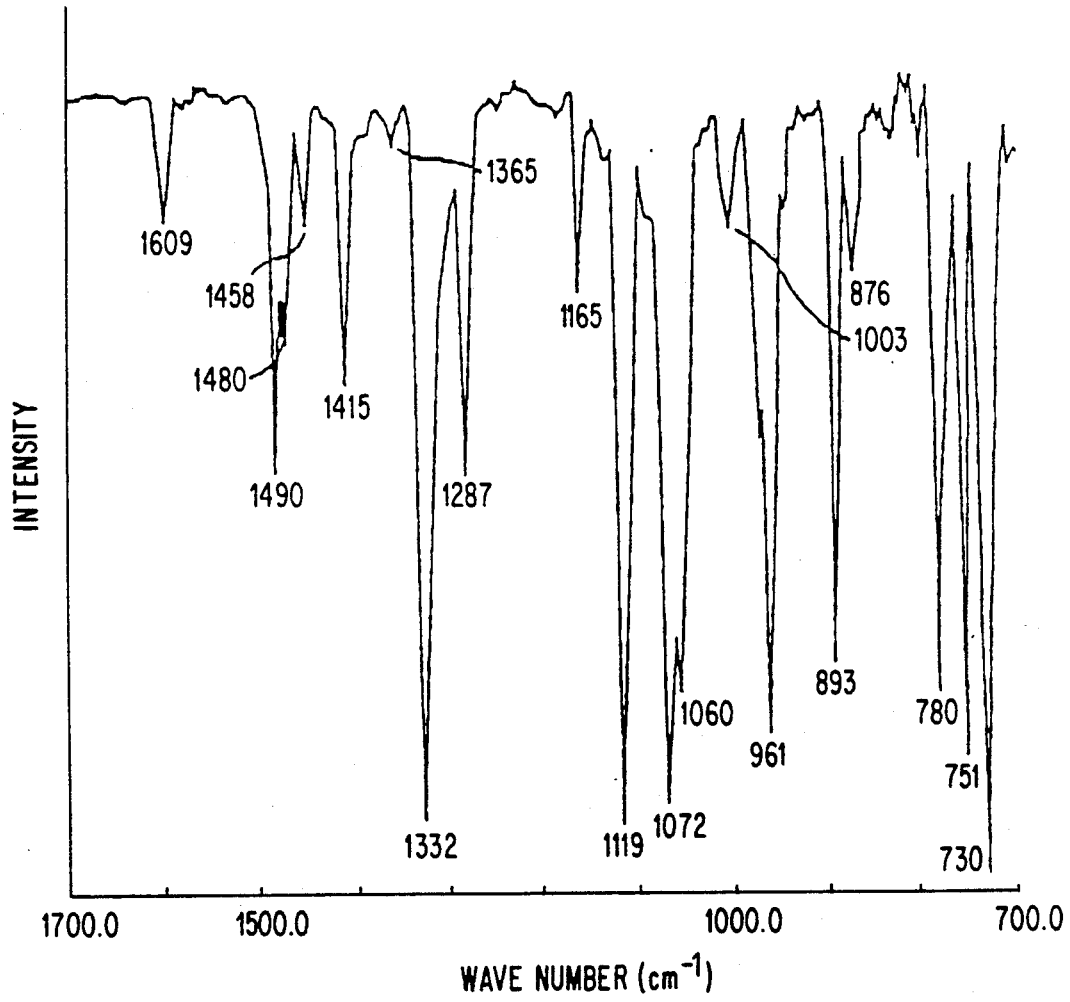
FIG. 1 is an infrared absorption spectrum for the titanyl phthalocyanine composition which can be used in accordance with the present invention.

The electrophotographic photosensitive material of the present invention may be produced by dissolving the poly-2,3-epoxypropyl carbazole compound of the formula [A] together with the hydrazone compound of the formula [I] and/or the butadiene compound of the formula [II] and with a resin or binder into a suitable solvent, adding thereto as occasion demands various additives such as a photoconductive material which absorbs light and generates an electric charge, a sensitizing dyestuff, an electron absorbing material, a deterioration prevention substance, a plasticizer, etc., coating the obtained liquid on a conductive substrate and then drying it to form a photosensitive layer having a thickness usually of 5–30 μm.

Mixing ratio of the hole transport materials and the resin may be 30–300 parts by weight preferably 50–200 parts by weight of the hole transport materials per 100 parts by weight of the resin. Mixing ratio of the poly-2,3-epoxypropyl carbazole compound, the hydrazone compound and the butadiene compound which constitute the hole transport materials may be 3–1,000 parts by weight preferably 10–100 parts by weight of the poly-2,3-epoxypropyl carbazole compound per 100 parts by weight of the hydrazone compound, the butadiene compound or a mixture of the hydrazone compound and the butadiene compound.

As for the resin to be used with the hole transport materials, an insulating resin such as silicon resin, ketone resin, polymethyl methacrylate, polyvinyl chloride, acrylic resin, polyarylate, polyester, polycarbonate, polystyrene, acrylonitrile-styrene copolymer, acrylonitrile-butadiene copolymer, polyvinyl butyral, polyvinyl formal, polysulfone, polyacrylamide, polyamide, chlorinated rubber or the like; polyvinyl anthracene, polyvinyl pyrene or the like may be mentioned. These resins may be used either singularly or in combination of two or more.

In order to avoid deterioration, it is possible and effective to add to the resin some usually employed additives, for example, an ultraviolet absorbent, an antioxidant, etc.

The coating may be applied by means of a spin coater, an applicator, a spray coater, a bar coater, a dip coater, a doctor blade, a roller coater, a curtain coater, a bead coater or the like so that a film having a thickness of 5–50 μm preferably 10–30 μm may be formed after drying.

The phthalocyanine compounds and the naphthalocyanine compounds that are used in the present invention as the change generation material can be obtained by such well-known methods as described in "Phthalocyanine Compounds" (Rheinhold Publishing Company, 1963) and "Phthalocyanines" (CRC Publications, 1983) by Moser and Thomas, or some other appropriate methods.

For example, titanyl phthalocyanine can readily be synthesized from 1,2-dicyanobenzene (o-phthalodinitrile) or its derivative and a metal or a metallic compound in accordance with a known method.

In the case of the titanium oxyphthalocyanines, for example, it can readily be synthesized according to the reaction formula shown in (1) or (2) below.

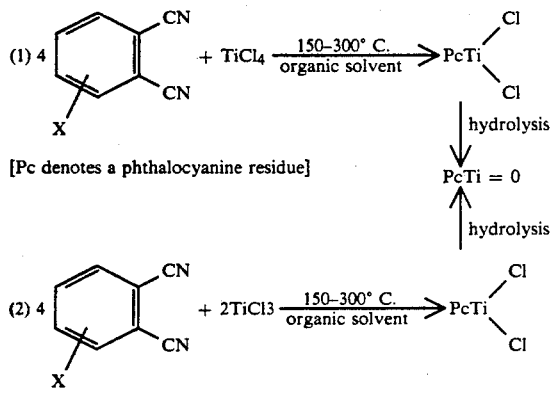

[Pc denotes a phthalocyanine residue]

As for the organic solvent, a high boiling point organic solvent inert to the reaction, for example, nitrobenzene, quinoline, α-chloronaphthalene, β-chloronaphthalene, α-methylnaphthalene, methoxynaphthalene, diphenylether, diphenylmethane, diphenylethane, ethyleneglycol dialkylether, diethyleneglycol dialkylether, triethyleneglycol dialkylether, or the like is preferred. The preferable reaction temperature ordinarily is 150°–300° C. and particularly 200°–250° C.

The thus obtained crude titanyl phthalocyanine compound is subjected to a non-crystallization treatment and then to a tetrahydrofuran treatment. Before these treatments, it is preferable to remove the organic solvent used in the condensation reaction by using alcohols such as methanol, ethanol or isopropyl alcohol; or ethers such as tetrahydrofuran or 1,4-dioxane; and then to effect a hot water treatment. Particularly it is preferable to do washing until pH value of the washing liquor after the hot water treatment becomes about 5 to 7.

It is further preferable to subsequently effect a treatment with an electron donating solvent such as 2-ethoxyethanol, diglyme, 1,4-dioxane, tetrahydrofuran, N,N-dimethylformamide, N-methylpyrrolidone, pyridine or morpholine.

Further, as aza-phthalocyanine porphin derivatives there are various kinds of porphins such as tetrapyridinoporhiladine in which one or more of the benzene nuclei of phthalocyanine are replaced by the quinoline nuclei, and as metallo-phthalocyanines, one may mention various kinds that contain copper, nickel, cobalt, zinc, tin, aluminum, titanium or the like.

Moreover, as the substituents of the phthalocyanines and the naphthalocyanines, there are amino group, nitro group, alkyl group, alkoxy group, cyano group, mercapto group, halogen atom and the like, and the sulfonic acid group, carboxylic acid group or their metallic salts, ammonium salts, amine salts or the like may be mentioned as relatively simple ones. Further, it is possible to introduce various substituents to the benzene nuclei via the alkylene group, sulfonyl group, carbonyl group, imino group or the like, and these may be mentioned those which are known as anticoagulants or crystal transformation inhibitors in the technical field of the conventional phthalocyanine pigments (see, for example, U.S. Pat. Nos. 3,973,981 and 4,088,507).

The composition ratio between titanyl phthalocyanine and the aza porphin derivatives or metal-free or metallo-phthalocyanine which may have substituents in benzene nuclei, or metal-free or metallo-phthalocyanine which may have substituents in naphtyl nuclei suffices if it is greater than 100 to 50 (in parts by weight), preferably in the range of 100 to (20–0.1) (in parts by weight). If the ratio exceeds the above level, crystals obtained will contain many individual crystals other than the mixed crystal composition, so that it becomes difficult to discriminate the material in the infrared spectra or the X-ray diffraction spectra. (These mixed composition will be referred to as titanyl phthalocyanine compositions hereinafter.)

Although noncrystalline titanyl phthalocyanine compositions can be obtained by a single chemical or mechanical method, it is preferable to obtain them by the combinations of various kinds of method.

For example, non-crystalline particles can be obtained by weakening the coagulating force between the particles by an acid pasting method, acid slurry method or the like, and then grinding the particles by any mechanical treating method. As for a grinding apparatus, a kneader, a Banbury mixer, an attritor, an edge runner mill, a roll mill, a ball mill, a sand mill, a homomixer, a SPEX mill, a disperser, an agitator, a jew crusher, a stamp mill, a cutter mill, a micronizer, etc. may be used, but these apparatuses are only for examples and do not mean any limitation to the grinding apparatus to be used. The acid pasting method, which is well known as a chemical treatment process, is one to pour a pigment dissolved in concentrated sulfuric acid of not less than 95% or a pigment in the form of a sulfate into water or ice water to precipitate it for separation. It is possible to obtain non-crystalline particles in better conditions by maintaining the sulfuric acid and water preferably not higher than 5° C. and by pouring the sulfuric acid slowly into water under highspeed stirring.

It is also possible to employ a method of grinding crystalline particles for a very long time by a direct mechanical treatment apparatus, a method of grinding the particles obtained by the acid pasting method after treatment by the solvent mentioned above, or the like. The non-crystalline particles may be obtained by sublimation. For example, the titanyl phthalocyanine compound obtained by any of the above mentioned processes is heated to 500°–600° C. under vacuum to sublime it and deposit it on a substrate.

New stable crystal can be obtained by treating the non-crystalline titanyl phthalocyanine compound obtained as above mentioned, in tetrahydrofuran. The treatment in tetrahydrofuran is performed by stirring in any stirring apparatus 1 part by weight of non-crystalline titanyl phthalocyanine compound and 5–300 parts by weight of tetrahydrofuran. As for temperature, either heating or cooling is possible, and the crystal growth becomes rapid when heated and slow when cooled. As for the stirring apparatus, not only a usual stirrer but also a supersonic dispersing apparatus, a comminuting apparatus such as a ball mill, a sand mill, a homo-mixer, a disperser, an agitator or a micronizer, and a mixing apparatus such as a conical blender or a V-shape mixer may suitably be used. These stirring apparatuses are mentioned only for examples and do not limit the apparatus to be used. After the stirring treatment, ordinarily filtration, washing and drying treatments are carried out to obtain a stabilized crystal form of the titanyl phthalocyanine. It is also possible to omit the filtration and the drying treatments, whereby to obtain a coating material by adding, if necessary, resins, etc. to the dispersion. This is very effective to save process steps when the titanyl phthalocyanine crystal is used as a coating film of an electrophotographic photosensitive material or the like.

An infrared absorption spectrum of the titanyl phthalocyanine composition obtained as in the above is shown in FIG. 1. The titanyl phthalocyanine shows characteristically strong absorption peaks at wavenumbers (in the unit of $cm^{-1}$, where errors of $\pm 2$ are included) 1490, 1480, 1415, 1365, 1332, 1165, 1119, 1072, 1060, 1003, 961, 893, 780, 751 and 730.

Figure 2:
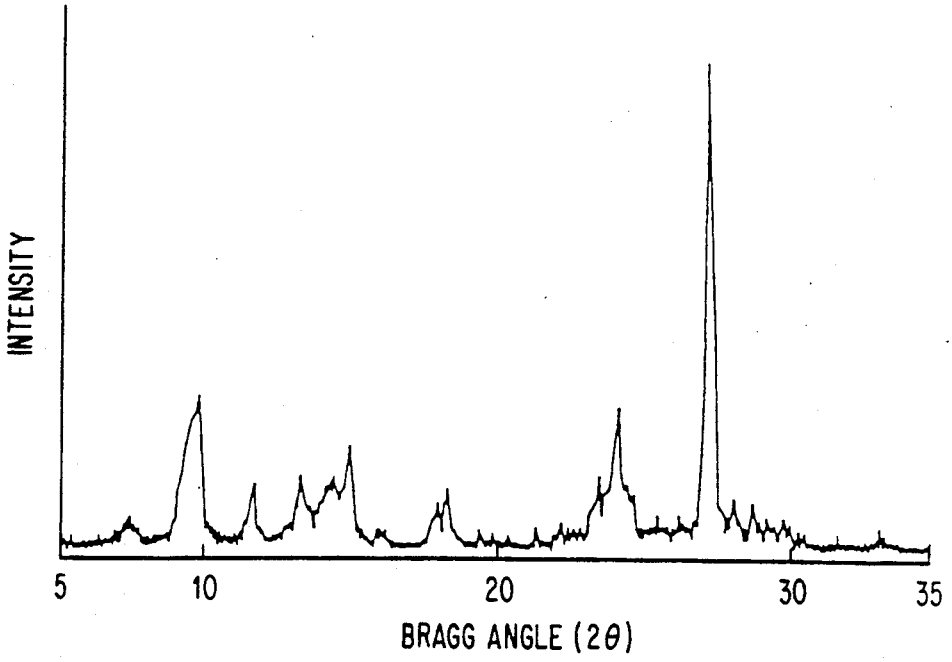
FIG. 2 is an X-ray diffraction pattern for the composition of FIG. 1.

Further, the X-ray diffraction patterns obtained by using the CuK$\alpha$ line are shown in FIG. 2. In the titanyl phthalocyanine composition there are two kinds, namely, one whose Bragg angle $2\theta$ (including an error range of $\pm 0.2°$) in the X-ray diffraction pattern has a strongest diffraction peak at 27.3° and strong peaks at 9.7° and 24.1°, and the other which has a strongest peak at 27.3° and strong peaks at 7.4°, 15.1°, 24.1°, 25.3° and 28.5°. From the fact that the intensity of the diffracted line is in general approximately proportional to the size of each crystal plane, the above-mentioned difference is considered due to the difference in the degree of growth of each crystal plane of crystals with identical structure.

The titanyl phthalocyanine consists of satisfactory crystals with extremely high stability which do not show any substantial change in the infrared absorption spectrum even when they are further heated and stirred in tetrahydrofuran in an attempt to enhance the crystal growth. By coating the above titanyl phthalocyanine composition as the charge generation agent on a substrate by using an appropriate binder, it is possible to obtain the charge generation layer which has an extremely high dispersibility and an extremely large photoelectric conversion efficiency.

The coating may be applied by means of a spin coater, an applicator, a spray coater, a bar coater, a dip coater, a doctor blade, a roller coater, a curtain coater, a bead coater, or the like so that a film having a thickness of 0.01–5 μm preferably 0.1–1 μm may be formed after drying. The drying is carried out preferably by heating at 40°–200° C. for ten minutes to six hours in the stationary or blown air.

The binder for use in forming the charge generation layer by coating may be selected from a wide scope of an insulating resin and also from an organic photoconductive polymer such as polyvinyl anthracene or polyvinyl pyrene. As for the insulating resin, polyvinyl butyral, polyarylate such as a polycondensate of bisphenol A and phthalic acid or the like, polycarbonate, polyester, phenoxy resin, polyvinyl acetate, acrylic resin, polyacrylamide resin, polyamide resin, polyvinyl pyridine, cellulosic resin, urethane resin, epoxy resin, silicon resin, polystyrene, polyketone, polyvinyl chloride, copolymer of vinyl chloride and vinyl acetate, polyvinyl acetal, polyacrylonitrile, phenol resin, melamine resin, casein, polyvinyl alcohol, polyvinyl pyrrolidone, etc. may be mentioned. The amount of the resin to be incorporated into the charge generation layer is suitably not more than 100 weight % preferably not more than 40 weight %. Further, the resin may be used either singularly or in combination of two or more. The solvent for the resin is selected in accordance with the kind of the resin to be used preferably so that no bad influence may be given to the application of coatings of charge transport layer and undercoat layer explained hereinafter. Such solvent is for example, an aromatic hydrocarbon such as benzene, xylene, ligroin, monochlorobenzene, dichlorobenzene or the like; a ketone such as acetone, methylethyl ketone, cyclohexanone or the like; an alcohol such as methanol, ethanol, isopropanol or the like; an ester such as ethyl acetate, methyl cellosolve or the like; an aliphatic halogenated hydrocarbon such as carbon tetrachloride, chloroform, dichloromethane dichloroethane, trichloroethylene or the like; an ether such as tetrahydrofuran, 1,4-dioxane, ethylene glycol monomethyl ether or the like; an amide such as N,N-dimethylformamide, N,N-dimethylacetoamide and a sulfoxide such as dimethyl sulfoxide.

In addition to these layers, it is possible to provide the conductive substrate with an undercoat layer for the purpose of preventing any reduction of electrostatic charging property and improving an adhesive property.

As an undercoat layer use may be made of alcohol soluble polyamides such as nylon 6, nylon 66, nylon 11, nylon 610, copolymerized nylon and alkoxymethylated nylon, casein, polyvinyl alcohol, nitrocellulose, ethyleneacrylic acid copolymer, gelatine, polyurethane, polyvinyl-butyral, and metallic oxide such as aluminum oxide. Further, it is also effective to incorporate conductive particles of such materials as a methallic oxide or carbon black in resin.

The film thickness of the undercoat layer suitably is 0.05–10 μm preferably 0.1–1 μm.

Further, it is desirable for the electrophotographic photosensitive material of the present invention to laminate an undercoat layer, a charge generation layer and a charge transport layer in this order on a conductive substrate. However, it may be the lamination in the order of an undercoat layer, the charge transport layer and the charge generation layer, or may be formed by coating the charge generation agent and the charge transport agent dispersed in an appropriate resin on an undercoat layer. It is to be noted that the undercoat layer in these cases may be omitted if so desired.

Figure 4:
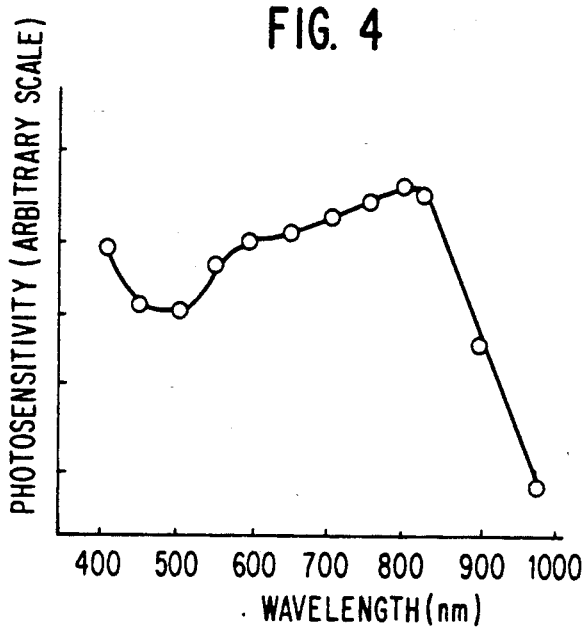
FIG. 4 shows a diagram for the spectral sensitivity characteristic of the electrophotographic photosensitive material of the present invention.

Moreover, the electrophotographic photosensitive material of the present invention has an absorption peak in the vicinity of 800 nm as shown in the spectral sensitivity characteristic curve of FIG. 4, so that they can not only be used for copying machines and printers as electrophotographic photosensitive material, but also will be effective when used for solar cells, photoelectric conversion elements and absorber for optical disks.

In the followings, the embodiments of the present invention will be described. It should be noted that the term "parts" to be used in connection with the embodiment and like signifies "parts by weight".

SYNTHESIS EXAMPLE 1

The raw materials in the quantities of 20.4 parts of o-phthalodinitrile and 7.6 parts of titanium tetrachloride in 50 parts of quinoline are heated to be brought into reaction at 200° C. for two hours. Then, the solvent is removed by steam distillation, refined with 2% aqueous solution of hydrochloric acid, subsequently with 2% aqueous solution of sodium hydroxide. After washing with methanol and N,N-dimethylformaldehyde, the sample is dried to obtain 21.3 parts of titanyl phthalocyanine (TiOPc).

SYNTHESIS EXAMPLE 2

The raw materials in the quantities of 14.5 parts of aminoiminoisoindolene in 50 parts of quinoline are heated at 200° C. for two hours, and after reaction, the solvent is removed by steam distillation, refined first with 2% aqueous solution of hydrochloric acid, then with sodium hydroxide. Then, after washing thoroughly with methanol and N,N-dimethylformaldehyde and drying, 8.8 parts of metal-free phthalocyanine (yield of 70%) are obtained.

SYNTHESIS EXAMPLE 3

The raw materials in the quantities of 20 parts of o-naphthalodinitrile in 50 parts of quinoline are brought to reaction by heating the mixture at 200° C. for 4 hours. After refining with 2% aqueous solution of hydrochloric acid, washing with methanol and N,N-dimethylformaldehyde, and drying, 15 parts of metal-free naphthalocyanine are obtained.

SYNTHESIS EXAMPLE 4

10 parts of 4-nitro-1,2-phthalodinitrile and 20 parts of 1,8-diazabicyclo [5, 4, 0]-7-undecene are reacted in 100 parts of 2,4-dichlorotoluene by heating at 70° C. for 6 hours. Precipitated crystals are filtered, washed with methanol and benzene and dried to obtain 11.5 parts of metal-free methoxy phthalocyanine.

SYNTHESIS EXAMPLE 5

18.4 parts of the metal-free methoxy phthalocyanine obtained in the above Synthesis Example 4 and 10 parts of titanium tetrachloride are reacted in 50 parts of quinoline by heating at 200° C. for 2 hours. The solvent is removed by steam distillation and then the reaction product is purified by 2% aqueous solution of hydrochloric acid and then 2% aqueous solution of sodium hydroxide, washed with methanol and N,N-dimethylformamide and dried to obtain 17.4 parts of titanyl methoxy phthalocyanine.

EMBODIMENT 1

One part of titanyl phthalocyanine obtained in the above Synthesis Example 1 and 0.05 part of metal-free phthalocyanine obtained in the above Synthesis Example 2 were dissolved in small quantities in 30 parts of 98% sulfuric acid at 5° C., and the mixture obtained was stirred for about one hour while keeping a temperature not above 5° C. Then, the sulfuric acid solution was poured gently into 500 parts of ice water stirred at high speed, and the crystals precipitated were filtered out. The crystals were washed with distilled water until no acid was detected to obtain a wet cake. The cake (assumed to contain one part of phthalocyanine) was stirred for about one hour in 100 parts of tetrahydrofuran, filtered and washed with tetrahydrofuran to obtain a tetrahydrofuran dispersed solution of titanyl phthalocyanine composition with pigment content of 0.95 part. A portion of the solution was dried and its infrared absorption spectrum and X-ray diffraction pattern were examined. As the result, the infrared absorption spectrum of the composition thus obtained was found to be of new type as shown in FIG. 1. In addition, its X-ray diffraction pattern is shown in FIG. 2.

Figure 3:
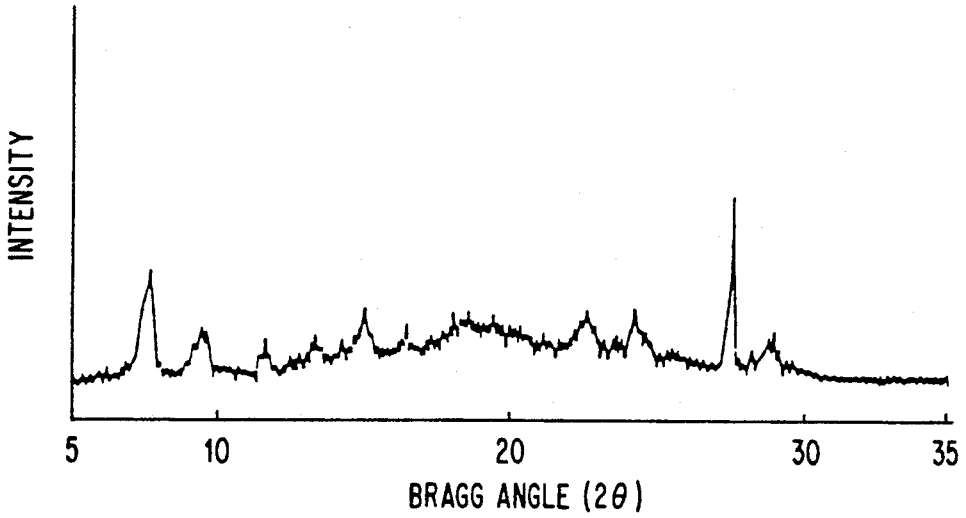
FIG. 3 is an X-ray diffraction pattern for the composition of FIG. 1 in the state of a coated film.

Next, a coating material was prepared using an ultrasonic disperser so as to contain 1.5 parts in dried weight of the present composition, one part of butyral resin (BX-1 manufactured by Sekisui Chemical Co., Japan) and 80 parts of tetrahydrofuran. A charge generation layer was obtained by coating the dispersed solution on an aluminum plate that has a 0.5 μm-thick coating of polyamide resin (CM-8000 manufactured by Toray, Japan) to have a dried film thickness of 0.3 μm. Infrared absorption spectrum and X-ray diffraction pattern at this stage were examined and found as shown in FIGS. 1 and 3.

On the charge generation layer as above formed, charge transport layer was formed by coating a solution of 20 parts of poly-2,3-epoxypropyl carbazole of the above formula [A] and 100 parts of p-diethylaminobenzaldehyde-(diphenyl hydrazone) of the above formula (b) as charge transport materials, 100 parts of polycarbonate resin (Z-200 manufactured by Mitsubishi Gas Chemical Co., Japan) and 5 parts of 2,4-bis-(n-octylthio)-6-(4-hydroxy-3,5-di-t-butylanilino-1,3,5-triazine dissolved in the mixture (in the ratio of 1 to 1) of toluene and tetrahydrofran to have a dried film thickness of 15 m.

As in the above, an electrophotographic photosensitive material having a laminated type photosensitive layer was obtained. The half-value exposure quantity ($E_{\frac{1}{2}}$) of this photosensitive material was measured using an electrostatic copying paper testing apparatus (EPA-8100 manufactured by Kawaguchi Denki Seisakusho, Japan). Namely, the sample was electrified at a dark place by a corona discharge of −5.5 kV, then exposed to a white light of illuminance 5 lux, and the exposure quantity required for attenuating the surface potential to one half ($E_{\frac{1}{2}}$ (lux.sec)) was determined.

EMBODIMENT 2

An electrophotographic photosensitive material was obtained in a manner similar to that of the Embodiment 1 except that o-methyl-p-dibenzylaminobenzaldehyde-(diphenylhydrazone) of the above formula (g) was used in place of the hydrazone compound of the formula (b) used in the Embodiment 1.

EMBODIMENT 3

An electrophotographic photosensitive material was obtained in a manner similar to that of the Embodiment 1 except that 1,1-bis-(p-diethylaminophenyl)-4,4-diphenyl-1,3-butadiene of the above formula (n) was used in place of the hydrazone compound of the formula (b) used in the Embodiment 1.

EMBODIMENT 4

A phthalocyanine composition was obtained in a manner similar to that of the Embodiment 1 except that 0.06 part of the metal-free methoxy phthalocyanine obtained in the above Synthesis Example 4 was used in place of the metal-free phthalocyanine used in the Embodiment 1. It was confirmed to have infrared absorption spectrum similar to that shown in FIG. 1.

An electrophotographic photosensitive material was obtained by forming a charge generation layer with use of the above phthalocyanine composition and then a charge transport layer thereon in a manner similar to that of the Embodiment 1.

EMBODIMENT 5

A phthalocyanine composition was obtained in a manner similar to that of the Embodiment 1 except that 0.08 part of the metal-free naphthalocyanine obtained in the above Synthesis Example 3 was used in place of the metal-free phthalocyanine used in the Embodiment 1. It was confirmed to have infrared absorption spectrum similar to that shown in FIG. 1.

An electrophotographic photosensitive material was obtained by forming a charge generation layer with use of the above phthalocyanine composition and then a charge transport layer thereon in a manner similar to that of the Embodiment 1, except that a solution of 50 parts of poly-2,3-epoxypropyl carbazole of the above formula [A], 70 parts of o-methyl-p-dibenzylaminobenzaldehyde-(diphenyl hydrazone) of the above formula (g), 30 parts of 1,1-bis-(p-diethylaminophenyl)-4,4-diphenyl-1,3-butadiene of the above formula (n), 50 parts of polycarbonate resin, 3 parts of 2,4-bis-(n-octylthio)-6-(4-hydroxy-3,5-di-t-butylanilino-1,3,5-triazine and 2 parts of 2-hydroxy-4-methoxybenzophenone dissolved in 600 parts of a mixture of toluene and tetrahydrofuran in a mixing ratio of 1:1 was used for coating the charge transport layer.

EMBODIMENT 6

A phthalocyanine composition was obtained in a manner similar to that of the Embodiment 1 except that 0.09 part of the titanyl methoxy phthalocyanine obtained in the above Synthesis Example 5 was used in place of the metal-free phthalocyanine used in the Embodiment 1. It was confirmed to have infrared absorption spectrum similar to that shown in FIG. 1.

An electrophotographic photosensitive material was obtained by forming a charge generation layer with use of the above phthalocyanine composition and then a charge transport layer thereon in a manner similar to that of the Embodiment 5, except that the amounts of poly-2,3-epoxypropyl carbazole and polycarbonate resin used were changed to 75 parts and 25 parts, respectively.

COMPARATIVE EXAMPLE 1

An electrophotographic photosensitive material was produced in a manner similar to the above Embodiment 1, except that a charge transport layer was formed by coating a solution of 100 parts of the hydrazone compound of the formula (b) and 100 parts of polycarbonate resin dissolved in 600 parts of a mixture of toluene and tetrahydrofuran in a mixing ratio of 1:1 on a charge generation layer formed in accordance with the above Embodiment 1.

COMPARATIVE EXAMPLE 2

An electrophotographic photosensitive material was produced in a manner similar to the above Comparative Example 1, except that the butadiene compound of the formula (n) was used in place of the hydrazone compound of the formula (b) for forming a charge transport layer.

COMPARATIVE EXAMPLE 3

An electrophotographic photosensitive material was produced in a manner similar to the above Comparative Example 1, except that a charge transport layer was formed by coating a solution of 100 parts of poly-2,3-epoxypropyl carbazole dissolved in 400 parts of dichloromethane on a charge generation layer formed in accordance with the above Comparative Example 1.

Evaluation of various properties of the electrophotographic photosensitive materials produced in the above Embodiments 1-6 and Comparative Examples 1-3 was made and its results are shown in the following table 1:

TABLE 1

| | V0 (−V) | $E_{\frac{1}{2}}$ (lux · sec) | V1 (−V) | VR (−V) | DDR (%) |
|---|---|---|---|---|---|
| Embodiment 1 | 878 | 0.3915 | 789 | 9 | 89.86 |
| Embodiment 2 | 902 | 0.3741 | 829 | 12 | 91.91 |
| Embodiment 3 | 887 | 0.3567 | 788 | 0 | 88.84 |
| Embodiment 4 | 872 | 0.3741 | 777 | 8 | 89.11 |
| Embodiment 5 | 903 | 0.3480 | 824 | 7 | 91.25 |
| Embodiment 6 | 876 | 0.3480 | 803 | 8 | 91.67 |
| Comparative Example 1 | 862 | 0.4760 | 750 | 20 | 87.01 |
| Comparative Example 2 | 846 | 0.3828 | 678 | 0 | 80.14 |
| Comparative Example 3 | 655 | 0.7917 | 565 | 84 | 86.26 |

In the above table 1, $V_0$ is the surface potential (−5 kV), $E_{\frac{1}{2}}$ is the half-value exposure quantity, V1 is the potential after dark attenuation (3 sec), $V_R$ is the residual surface potential after irradiation with light and DDR is the dark attenuation factor.

As it is understood from the above table 1, when the poly-2,3-epoxypropyl carbazole, the hydrozone compound and the butadiene compound are used alone (Comparative Examples 1-3), defects such as large residual potential and large dark attenuation are caused and so the obtained photosensitive material is not desirable, but when the poly-2,3-epoxypropyl carbazole is used together with the hydrazone compound or the butadiene compound or with both of these compounds in combination, adhesiveness is increased to enable use of a photoconductive material in a higher concentration and so an electrophotographic photosensitive material having an excellent electrostatic property is obtained.

Further, the charge generation materials that can be used in the present invention includes those of novel and stable crystals. They are stable against solvents so that when they are made into coating materials, solvent selection becomes easier, enabling to obtain coating materials that have excellent dispersibility and long life, which facilitates the formation of homogeneous films that are important in the manufacture of photosensitive bodies.

The electrophotographic photosensitive materials obtained have high photosensitivity especially for the semiconductor laser wavelength region, so that they are particularly effective for photosensitive bodies for high speed and high definition printers.

What is claimed is:

1. An electriphotographic photosensitive material comprising a charge generation layer and a charge transport layer, wherein the charge transport layer contains, as a hole transport material for forming the charge transport layer, a poly-2,3-epoxypropyl carbazole compound represented by formula (A) together with at least one of a hydrazone compound represented by formula (I) and a butadiene compound represented by formula (II):

(A)

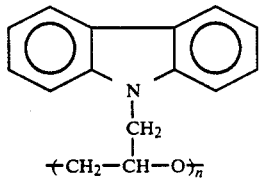

(I)

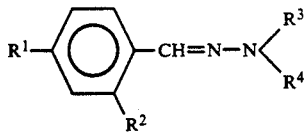

wherein $R^1$ is a hydrogen atom, a substituted or unsubstituted alkyl or alkoxy group, a halogen atom or a substituted or unsubstituted amino, morpholino or piperidino group, or $R^1$ may form a substituted or unsubstituted carbazolyl group together with the phenyl group in formula (I); $R^2$ is a hydrogen atom or a substituted or unsubstituted alkyl, alkoxy or aralkyloxy group; and $R^3$ and $R^4$ independently or both are a hydrogen atom or a substituted or unsubstituted alkyl, aryl or aralkyl group, or $R^3$ and $R^4$ may form a ring with the nitrogen atom to which they are bonded to form a substituted or unsubstituted heterocyclic group;

(II)

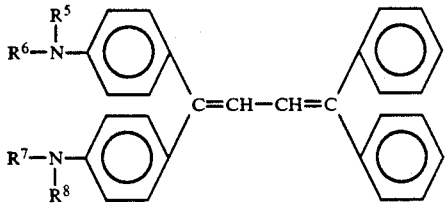

wherein $R^5$, $R^6$, $R^7$ and $R^8$ are the same or different alkyl groups;

wherein the charge generated and transported in the photosensitive material is a negative charge; and wherein the charge transport layer further contains a film-forming resin which is different from the poly-2,3-epoxypropyl carbazole compound.

2. An electrophotographic photosensitive material according to claim 1, wherein the photosensitive material contains the poly-2,3-epoxypropyl carbazole compound of formula (A) and the hydrazone compound of formula (I).

3. An electrophotographic photosensitive material according to claim 1, wherein the photosensitive material contains the poly-2,3-epoxypropyl carbazole compound of formula (A) and the butadiene compound of formula (II).

4. An electriphotographic photosensitive material according to claim 1, wherein the photosensitive material contains the poly-2,3-epoxypropyl carbazole compound of formula (A), the hydrazone compound of formula (I), and the butadiene compound of formula (II).

5. An electrophotographic photosensitive material according to claim 1, wherein $R^3$ and $R^4$ form a ring with the nitrogen atom to which they are bonded to form a substituted or unsubstituted pyridinium, piperidino, or carbazolyl group.

6. An electrophotographic photosensitive material comprising a charge generation layer formed on a substrate and a charge transport layer formed on the charge generation layer, wherein:

(a) said charge generation layer contains as an effective constituent a charge generation material which is a crystal composition comprising 100 parts by weight of titanyl phthalocyanine and a total of at most 50 parts by weight of at least one member selected from the group consisting of metal-free aza porphin derivatives, metallo-aza porphin derivatives, metal-free phthalocyanine, metallo-phthalocyanine, metal-free naphthalocyanine, and metallo-naphthalocyanine, wherein the benzene nucleus in the metal-free aza porphin derivatives, metallo-aza porphin derivatives, metal-free phthalocyanine, and metallo-phthalocyanine may be substituted, and the naphthyl nucleus in the metal-free naphthalocyanine and metallo-naphthalocyanine may be substituted, and having in its infrared absorption spectrum characteristically strong absorptions at absorption wavelengths of 1490±2, 1415±2, 1332±2, 1119±2, 1072±2, 1060±2, 961±2, 893±2, 780±2, 751±2 and 730±2 in units of $cm^{-1}$, (b) said charge transport layer contains, as a charge transport material which is a hole transport material, a poly-2,3-epoxypropyl carbazole compound represented by formula (A) together with at least one of a hydrazone compound represented by formula (I) and a butadiene compound represented by formula (II):

(A)

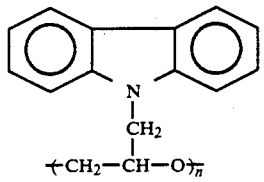

(I)

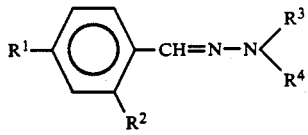

wherein $R^1$ is a hydrogen atom, a substituted or unsubstituted alkyl or alkoxy group, a halogen atom or a substituted or unsubstituted amino, morpholino or piperidino group, or $R^1$ may form a substituted or unsubstituted carbazolyl group together with the phenyl group in formula (I); $R^2$ is a hydrogen atom or a substituted or unsubstituted alkyl, alkoxy or aralkyloxy group; and $R^3$ and $R^4$ independently or both are a hydrogen atom or a substituted or unsubstituted alkyl, aryl or aralkyl group, or $R^3$ and $R^4$ may form a ring with the nitrogen atom to which they are bonded to form a substituted or unsubstituted heterocyclic group;

(II)

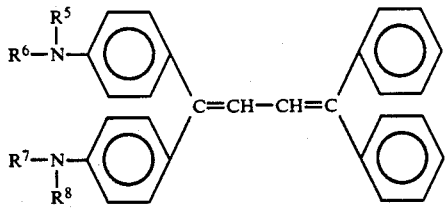

wherein $R^5$, $R^6$, $R^7$ and $R^8$ are the same or different alkyl groups;

wherein the charge generated and transported in the photosensitive material is a negative charge; and wherein the charge transport layer further contains a film-forming resin which is different from the poly-2,3-epoxypropyl carbazole compound.

7. An electrophotographic photosensitive material according to claim 6, wherein $R^3$ and $R^4$ form a ring with the nitrogen atom to which they are bonded to form a substituted or unsubstituted pyridinium, piperidino, or carbazolyl group.

* * * * *